United States Patent [19]

Binversie et al.

[11] Patent Number: 4,795,383

[45] Date of Patent: Jan. 3, 1989

[54] MARINE PROPULSION DEVICE LOW-SPEED EXHAUST SYSTEM

[75] Inventors: Gregory J. Binversie, Grayslake; Robert W. Gerdes, Winthrop Harbor; James E. Macier, Zion, all of Ill.

[73] Assignee: Outboard Marine Corporation, Waukegan, Ill.

[21] Appl. No.: 58,365

[22] Filed: Jun. 4, 1987

[51] Int. Cl.[4] ..... B63H 21/38

[52] U.S. Cl. ..... 440/89

[58] Field of Search ..... 440/89, 76, 900, 77; 123/195 P; 181/220, 227, 228, 235, 231, 260, 238, 264, 265, 266, 269, 275, 204

[56] References Cited

U.S. PATENT DOCUMENTS

| | | | |
|---|---|---|---|
| 1,816,371 | 7/1931 | Hefti | 440/89 |
| 3,045,423 | 7/1962 | Hulsebus | 60/32 |
| 3,198,162 | 8/1965 | Larsen | 115/17 |
| 3,282,373 | 11/1966 | Gazzara | 181/39 |
| 3,296,997 | 1/1967 | Hoiby et al. | 115/5 |
| 3,310,022 | 3/1967 | Kollman | 440/89 |
| 3,350,879 | 11/1967 | Boda et al. | 60/31 |
| 3,520,270 | 7/1970 | Miller | 115/17 |
| 3,577,952 | 5/1971 | Tado | 115/17 |
| 3,740,614 | 8/1973 | Giacosa | 440/38 |
| 3,759,041 | 9/1973 | North et al. | 60/310 |
| 3,911,852 | 10/1975 | Miller et al. | 115/17 |
| 3,967,446 | 7/1976 | Harralson et al. | 60/312 |
| 4,019,456 | 4/1977 | Harbert | 440/89 |
| 4,036,162 | 7/1977 | Maier et al. | 115/17 |
| 4,145,988 | 3/1979 | Harada | 115/73 |
| 4,303,401 | 12/1981 | Sanmi et al. | 440/88 |
| 4,354,849 | 10/1982 | Sanmi et al. | 440/88 |
| 4,421,490 | 12/1983 | Nakahama | 440/89 |
| 4,504,238 | 3/1985 | Neisen | 440/89 |
| 4,507,092 | 3/1985 | Hall et al. | 440/89 |
| 4,589,852 | 5/1986 | Price | 440/89 |
| 4,604,069 | 8/1986 | Taguchi | 440/88 |
| 4,607,723 | 8/1986 | Okazaki | 181/272 |
| 4,668,199 | 5/1987 | Freund et al. | 440/89 |
| 4,687,450 | 8/1987 | Bland | 440/89 |

FOREIGN PATENT DOCUMENTS

| | | |
|---|---|---|
| 54-25059 | 3/1979 | Japan . |
| 55-133541 | 9/1980 | Japan . |
| 55-155500 | 11/1980 | Japan . |
| 55-156562 | 11/1980 | Japan . |
| 57-68908 | 4/1982 | Japan . |

*Primary Examiner*—Joseph F. Peters, Jr.
*Assistant Examiner*—Edwin L. Swinehart
*Attorney, Agent, or Firm*—Michael, Best & Friedrich

[57] ABSTRACT

A marine propulsion device comprising an engine including an exhaust outlet, a lower unit adapted to be mounted on a boat for pivotal movement relative thereto about a generally vertical steering axis, the lower unit including a rotatably mounted propeller driven by the engine, an annular chamber having a circumferential length and including a lower portion filled with water, an exhaust gas inlet located below the level of the water and communicating with the exhaust outlet, and an exhaust gas outlet located above the level of the water, and a seal for requiring exhaust gases flowing from the chamber inlet to the chamber outlet to flow around the chamber through a distance substantially greater than 50% of the circumferential length of the chamber.

24 Claims, 4 Drawing Sheets

MARINE PROPULSION DEVICE LOW-SPEED EXHAUST SYSTEM

BACKGROUND OF THE INVENTION

The invention relates to exhaust systems for marine propulsion devices, and, more Particularly, to low-speed exhaust systems for marine propulsion devices.

Marine propulsion device exhaust gases are typically discharged underwater, with the exhaust gases flowing downwardly through the lower unit and then out through the propeller. At relatively high boat speeds, a low pressure region exists behind the propeller and exhaust gases are easily discharged through the propeller. At engine idle or relatively low boat speeds, water backs up into the exhaust gas passageway and creates a back pressure which restricts or prevents the discharge of exhaust gases through the propeller.

Exhaust systems have been provided for discharging exhaust gases through a discharge outlet located above the water when the engine is operating at relatively low speeds. An example of such a system is disclosed in U.S. patent application Ser. No. 754,534 to Wenstadt, filed July 12, 1985, and assigned to the assignee of this application.

Attention is also directed to the following U.S. Patents:

| Patentee | U.S. Pat. No. | Issue Date |
|---|---|---|
| Hulseous | 3,045,423 | July 24, 1962 |
| Larsen | 3,198,162 | August 3, 1965 |
| Gazzara | 3,282,373 | November 1, 1966 |
| Hoiby et al. | 3,296,997 | January 10, 1967 |
| Kollman | 3,310,022 | March 21, 1967 |
| Boda et al. | 3,350,879 | November 7, 1967 |
| Miller | 3,520,270 | July 14, 1970 |
| Tado | 3,577,952 | May 11, 1971 |
| Miller et al. | 3,911,852 | October 14, 1975 |
| Harralson et al. | 3,967,446 | July 6, 1976 |
| Maier et al. | 4,036,162 | July 19, 1977 |
| Harbert | 4,019,456 | April 26, 1977 |
| Harada | 4,145,988 | March 27, 1979 |
| Sanmi et al. | 4,303,401 | December 1, 1981 |
| Sanmi et al. | 4,354,849 | October 19, 1982 |
| Nakahama | 4,421,490 | December 20, 1983 |
| Hall et al. | 4,507,092 | March 26, 1985 |
| Price | 4,589,852 | May 20, 1986 |
| Taguchi | 4,604,069 | August 5, 1986 |
| Okazaki | 4,607,723 | August 26, 1986 |

Attention is also directed to the following Japanese patent applications: Application No. 54-25059, filed Mar. 6, 1979; Application No. 55-133541, filed Sept. 25, 1980; Application No. 55-155500, filed Nov. 5, 1980; Application No. 55-156562, filed Nov. 7, 1980; and Application No. 57-68908, filed Apr. 24, 1982.

SUMMARY OF THE INVENTION

The invention provides a marine propulsion device comprising an engine including an exhaust outlet, a lower unit including a rotatably mounted propeller driven by the engine, means defining an annular chamber having a circumferential length and including a lower portion filled with water, an exhaust gas inlet located below the level of the water and communicating with the exhaust outlet, and an exhaust gas outlet located above the level of the water, and means for requiring exhaust gases flowing from the chamber inlet to the chamber outlet to flow around the chamber through a distance substantially greater than 50% of the circumferential length of the chamber.

In one embodiment, the marine propulsion device further comprises a second exhaust outlet, and conduit means communicating between the engine exhaust outlet and the second exhaust outlet, and the annular chamber surrounds the conduit means so that the water cools the conduit means and the exhaust gases therein.

In one embodiment, the chamber inlet and the chamber outlet are spaced apart substantially less than 50% of the circumferential length of the chamber and divide the chamber into a short segment extending between the chamber inlet and the chamber outlet and a long segment extending between the chamber inlet and the chamber outlet, and the requiring means includes means for preventing exhaust gases from flowing through the short segment from the chamber inlet to the chamber outlet.

In one embodiment, the means defining the chamber includes an inner wall and an outer wall, and the preventing means includes a seal extending between the inner wall and the outer wall.

In one embodiment, the chamber has a forward portion, opposite first and second side portions, and a rearward portion, the chamber outlet and the chamber inlet are located in the forward portion, and the requiring means includes means for requiring exhaust gases flowing from the chamber inlet to the chamber outlet to flow from the forward portion to the rearward portion along the first side portion, around the rearward portion, and from the rearward portion to the forward portion along the second side portion.

In one embodiment, the marine propulsion device further comprises a second exhaust outlet, and means communicating between the chamber outlet and the second exhaust outlet.

In one embodiment, the marine propulsion device has a forward end and a rearward end, the second exhaust outlet is located adjacent the rearward end, and the chamber inlet and the chamber outlet are located adjacent the forward end.

In one embodiment, the marine propulsion device further comprises an adaptor connecting the lower unit to the engine and including a first passage extending through the adaptor and communicating between the engine exhaust outlet and the chamber inlet, and the means communicating between the chamber outlet and the second exhaust outlet includes a second passage extending through the adaptor.

In one embodiment, the second exhaust outlet is located in the adaptor.

The invention also provides a marine propulsion device comprising an engine including an exhaust outlet, a lower unit adapted to be mounted on a boat for pivotal movement relative thereto about a generally vertical steering axis, the lower unit including a rotatably mounted propeller driven by the engine, a high-speed exhaust outlet, and a low-speed exhaust outlet, a generally vertically extending conduit communicating between the engine exhaust outlet and the high-speed exhaust outlet, wall means surrounding the conduit and defining a water jacket between the wall means and the conduit, the water jacket including a lower portion filled with water, a forward portion, opposite first and second side portions, a rearward portion, an exhaust gas inlet located below the level of the water and in the forward portion, the exhaust gas inlet communicating with the engine exhaust outlet, and an exhaust gas outlet located above the level of the water and in the forward portion, seal means located between the water jacket inlet and the water jacket outlet and extending between the wall means and the conduit for requiring exhaust gases flowing from the water jacket inlet to the water jacket outlet to flow from the forward portion to the rearward portion along the first side portion, around the rearward portion, and from the rearward portion to the forward portion along the second side portion, and means communicating between the water jacket outlet and the low-speed exhaust opening.

The invention also provides a marine propulsion device comprising an engine including an exhaust outlet, a lower unit including a high-speed exhaust outlet and a rotatably mounted propeller driven by the engine, a generally vertical conduit communicating with the high-speed exhaust outlet, wall means surrounding the conduit and defining a water jacket between the wall means and the conduit, the water jacket including a lower portion filled with water, a forward portion, and an exhaust gas inlet located below the level of the water and communicating with the engine exhaust outlet, and an adaptor connecting the engine to the lower unit, the adaptor including a first passage communicating between the engine exhaust outlet and the conduit, a port located forwardly of the passage and communicating with the forward portion of the water jacket at a point above the level of the water in the water jacket, a low speed exhaust outlet located rearwardly of the first passage, and a second passage extending interiorly of the adaptor and communicating between the port and the low-speed exhaust outlet.

The invention also provides an adaptor for an outboard motor including a lower unit, and an engine having an exhaust outlet, the adaptor having forward and rearward ends and comprising an upper face adapted to be connected to the engine and having therein a first exhaust inlet adapted to communicate with the engine exhaust outlet, a lower face adapted to be connected to the lower unit and having therein a first exhaust outlet, and a second exhaust inlet located forwardly of the first exhaust outlet, a first passage extending interiorly of the adaptor and communicating between the first inlet and the first outlet, a second exhaust outlet located rearwardly of the first exhaust outlet, and a second passage extending interiorly of the adaptor and communicating between the second inlet and the second outlet.

The invention also provides an adaptor for an outboard motor including a lower unit, and an engine having an exhaust outlet, the adaptor comprising an upper face adapted to be connected to the engine, a lower face adapted to be connected to the lower unit and having therein an exhaust inlet port, the exhaust inlet port having an area and being adapted to communicate with the engine exhaust outlet, an exhaust outlet port, and a passage communicating between the exhaust inlet port and the exhaust outlet port and including an interior portion having an area greater than the area of the exhaust inlet port.

The invention also provides an adaptor for an outboard motor including a lower unit, and an engine having an exhaust outlet, the adaptor comprising an upper face adapted to be connected to the engine, a lower face adapted to be connected to the lower unit, and muffler means including an exhaust inlet port located in the lower face and adapted to communicate with the engine exhaust outlet, an exhaust outlet port, and a passage communicating between the inlet port and the outlet Port and having therein an expansion chamber.

A principal feature of the invention is the provision of an exhaust system including an annular chamber including a lower portion filled with water, an exhaust inlet located below the level of the water, an exhaust outlet located above the level of the water, and means for requiring exhaust gases flowing from the inlet to the outlet to flow around the chamber through a distance substantially greater than 50% of the circumferential length of the chamber. Unlike prior constructions, this arrangement provides an exhaust discharge without water spray.

Another principal feature of the invention is the provision of an adaptor comprising forward and rearward ends, an upper face adapted to be connected to an engine and having therein a first exhaust inlet, a lower face adapted to be connected to a lower unit and having therein a first exhaust outlet, and a second exhaust inlet located forwardly of the first exhaust outlet, a first passage extending interiorly of the adaptor and communicating between the first inlet and the first outlet, a second outlet located rearwardly of the first exhaust outlet, and a second passage extending interiorly of the adaptor and communicating between the second inlet and the second outlet.

Another Principal feature of the invention is the provision of an adaptor including muffler means, the muffler means including an exhaust inlet port in the lower face of the adaptor, an exhaust outlet port, and a passage communicating between the inlet port and the outlet port and having therein an expansion chamber. Unlike prior adaptor constructions, this construction provides additional silencing of idle exhaust gases before they are discharged.

Other principal features and advantages of the invention will become apparent to those skilled in the art upon review of the following detailed description, claims, and drawings.

Figure 1:
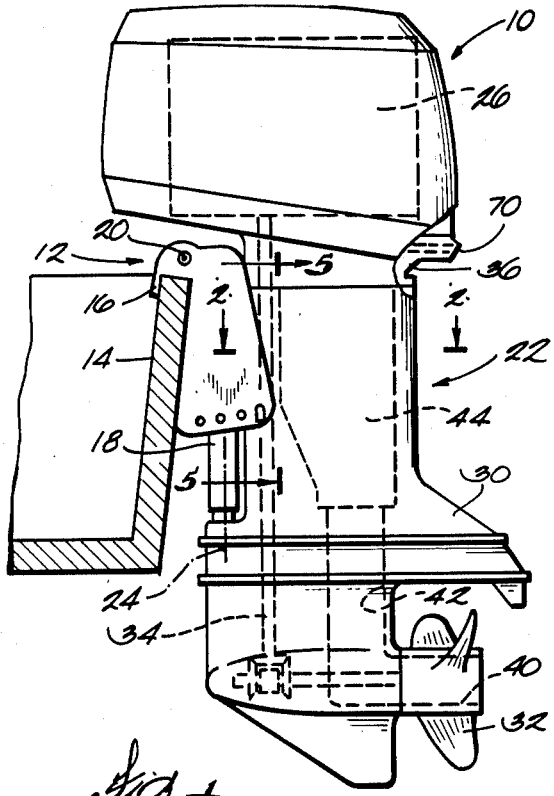
FIG. 1 is a side elevational view of a marine propulsion device embodying the invention.
Figure 3:
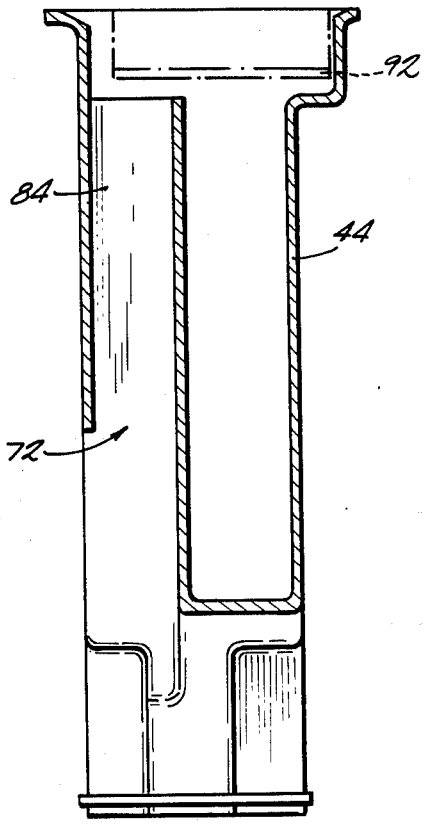
FIG. 3 is a view taken along line 3—3 in FIG. 2.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. While the illustrated marine propulsion device 10 is an outboard motor, it should be understood that the invention is applicable to other types of marine propulsion devices, such as stern drive units.

As shown in FIG. 1, the marine propulsion device 10 comprises a mounting assembly 12 mounted on the transom 14 of a boat. While various suitable mounting assemblies can be employed, in the preferred embodiment, the mounting assembly 12 includes a transom bracket 16 fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24. The propulsion unit 22 has forward and rearward ends (left and right in FIG. 1) and includes an internal combustion engine 26. The engine 26 includes an exhaust outlet 28 (see FIG. 6). The propulsion unit 22 also includes a lower unit 30 including a rotatably mounted propeller 32 which is driven by the engine 26 via a conventional drive train 34. The propulsion unit 22 further includes an adaptor 36 connecting the engine 26 to the lower unit 30. The adaptor 36 has forward and rearward ends and includes an upper face 37 connected to the engine 26, a lower face 38 connected to the lower unit 30, and a side face 39 extending between the lower face 38 and the upper face 37. The adaptor 36 also includes an exhaust inlet 41 located in the adaptor upper face 37 and communicating with the engine exhaust outlet 28, an exhaust outlet 43 located in the adaptor lower face 38, and a generally vertical exhaust passage 50 extending interiorly of the adaptor 36 and communicating between the inlet 41 and the outlet 43.

Figure 6:
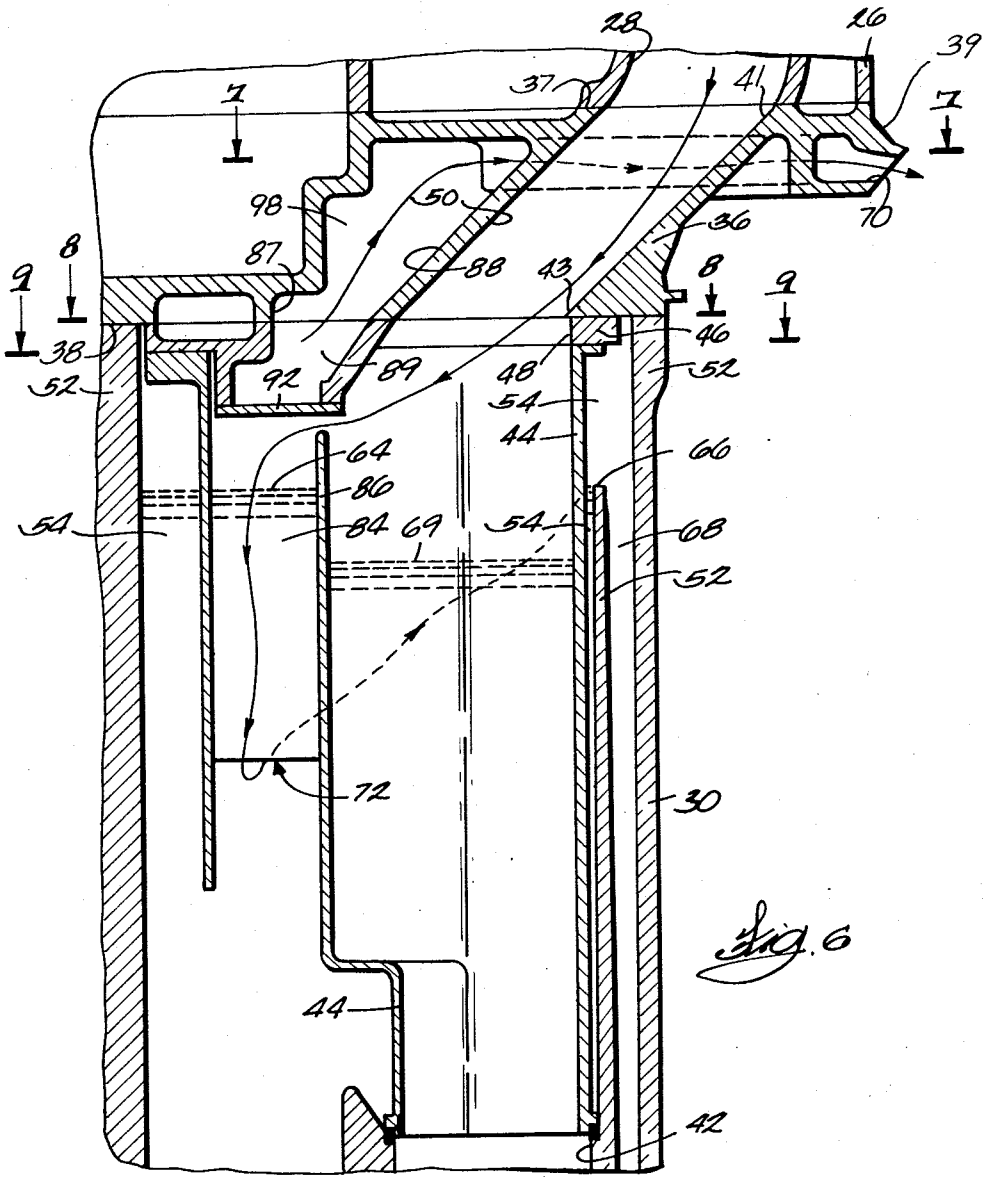
FIG. 6 is a view taken along line 6—6 in FIG. 5.
Figure 5:
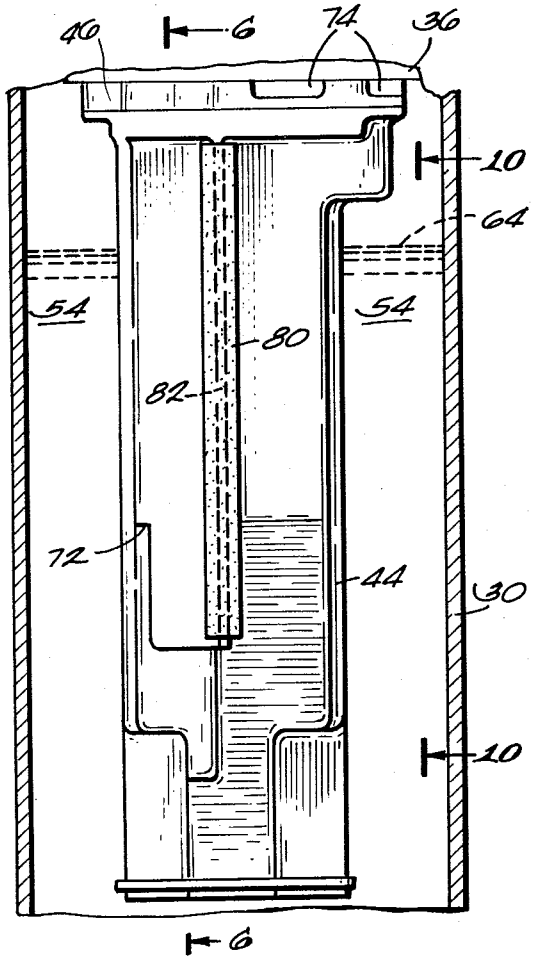
FIG. 5 is a view taken along line 5—5 in FIG. 1.

The marine propulsion device 10 also comprises a high-speed exhaust outlet 40 in the propeller 32, and means communicating between the adaptor exhaust outlet 43 and the high-speed exhaust outlet 40. While various suitable means can be used, in the illustrated construction, this means includes a lower exhaust passageway 42 located in the lower unit 30 and communicating with the high-speed exhaust outlet 40, and an inner housing or conduit 44 located within the lower unit 30 and having a lower end communicating with the lower exhaust passageway 42. The inner housing 44 has an upper end which is mounted on the lower end of the adaptor 36 via a connector plate 46. As shown in FIG. 6, the connector plate 46 has therein an exhaust passage 48 communicating between the upper end of the inner housing 44 and the adaptor exhaust outlet 43. Thus, the engine exhaust outlet 28 is connected to the high-speed exhaust outlet 40 via the adaptor inlet 41, the adaptor exhaust passage 50, the adaptor outlet 43, the connector plate exhaust passage 48, the inner housing 44, and the lower exhaust passage 42.

Figure 2:
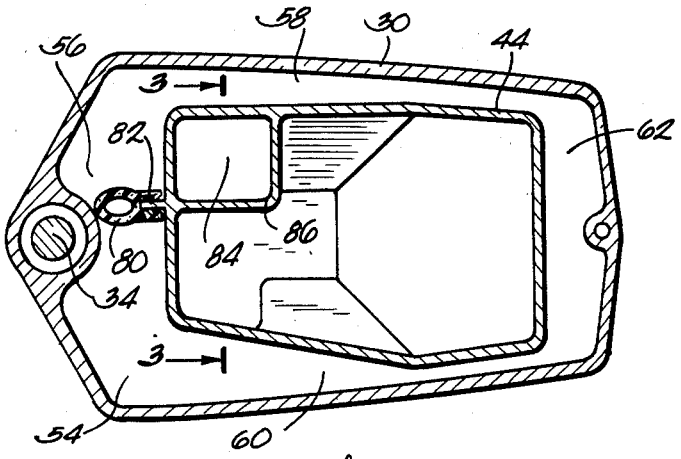
FIG. 2 is a view taken along line 2—2 in FIG. 1.
Figure 4:
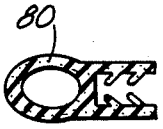
FIG. 4 is an enlarged cross-sectional view of the seal shown in FIG. 2.

In order to cool the inner housing 44 and the exhaust gases therein, the marine propulsion device 10 further comprises wall means 52 surrounding the inner housing 44 and defining a water jacket or annular chamber 54 between the wall means 52 and the inner housing 44. In the preferred embodiment, the wall means 52 includes the outer wall of the lower unit 30. As best shown in FIG. 2, the water jacket 54 has a circumferential length, a lower portion filled with water, a forward portion 56, opposite first and second side portions 58 and 60, respectively, and a rearward portion 62. The level 64 of the water is controlled by a dam or weir 66 over which the water jacket 54 communicates with the upper end of a duct 68 having a lower end which discharges underwater. The water in the water jacket 54 can be provided by any suitable means. In the preferred embodiment, water is discharged from the engine water jacket (not shown) to the water jacket 54. In alternative embodiments, water can be pumped from outside the lower unit 30 directly into the water jacket 54.

As explained previously, exhaust gases are easily discharged through the high-speed exhaust outlet 40 when the engine 26 is operating at relatively high speeds. When the engine 26 is operating at relatively low speeds, water backs up into the inner housing 44 and restricts or prevents discharge of exhaust gases through the high-speed exhaust outlet 40. The level 69 of the backed up water is shown in FIG. 6. Therefore, the marine propulsion device 10 further comprises means for discharging exhaust gases above the water when the engine 26 is operating at relatively low speeds. The means for discharging exhaust gases above water includes a low-speed exhaust outlet 70 which, in the preferred embodiment, is located in the side face 39 of the adaptor 36 at the rearward end of the adapter 36, and means communicating between the engine exhaust outlet 28 and the low-speed exhaust outlet 70.

The means communicating between the engine exhaust outlet 28 and the low-speed exhaust outlet 70 causes the exhaust gases to 'bubble up' through the water jacket 54 in order to both cool and silence the exhaust. Accordingly, the means communicating between the engine exhaust outlet 28 and the low-speed exhaust outlet 70 includes an exhaust gas inlet 72 and an exhaust gas outlet 74 in the water jacket 54. The inlet 72, which is an opening in the inner housing 44, is located below the level 64 of the water in the water jacket 54 and in the forward portion 56 of the water jacket 54. The outlet 74, which is an opening formed by the connector plate 46 and the adaptor 36, is located above the level 64 of the water in the water jacket 54 and in the forward portion 56 of the water jacket 54. In the preferred embodiment, the inlet 72 and the outlet 74 are spaced apart substantially less than 50% of the circumferential length of the water jacket 54 and divide the water jacket 54 into a short segment extending between the inlet 72 and the outlet 74 (and including only part of the forward portion 56 of the water jacket 54), and a long segment extending between the inlet 72 and the outlet 74 (and including the first side portion 58, the rear portion 62, and the second side portion 60 of the water jacket 54).

The means communicating between the engine exhaust outlet 28 and the low-speed exhaust outlet 70 also includes means for requiring exhaust gases flowing from the water jacket inlet 72 to the water jacket outlet 74 to flow around the water jacket 54 through a distance substantially greater than 50% of the circumferential length of the water jacket 54.

While various suitable requiring means can be employed, in the preferred embodiment, the requiring means includes means for preventing exhaust gases from flowing through the short segment of the water jacket 54 from the water jacket inlet 72 to the water jacket outlet 74. Alternatively stated, the requiring means includes means for requiring exhaust gases flowing from the inlet 72 to the outlet 74 to flow from the forward portion 56 to the rearward portion 62 along the first side portion 58, around the rearward portion 62, and from the rearward portion 62 to the forward portion 56 along the second side portion 60. While various suitable means can be used, in the illustrated construction, such means includes a seal 80 extending between the inner housing 44 and the lower unit 30 and located in the forward portion 56 or short segment of the water jacket 54. As shown in FIG. 2, the inner housing 44 has thereon a vertically extending flange 82, and the seal 80 is mounted on the flange 82. Referring to FIG. 2, the seal 80 forces exhaust gases entering the water jacket 54 through the inlet 72 to flow clockwise around the water jacket 54 to the outlet 74 and prevents them from flowing counterclockwise, or downwardly across the forward portion 56, to the outlet 74.

The means communicating between the engine exhaust outlet 28 and the low-speed exhaust outlet 70 also includes means communicating between the engine exhaust outlet 28 and the water jacket inlet 72. While various suitable means can be employed, in the preferred embodiment, this means includes the adaptor inlet 41, the adaptor passage 50, the adaptor outlet 43, the connector plate passage 48, the upper portion of the inner housing 44, and a vertically extending duct 84 within the inner housing 44. The duct 84 is formed in part by the outer wall of the inner housing 44, and in part by an L-shaped wall 86 integrally connected at both ends to the outer wall of the inner housing 44. The duct 84 has a lower end which communicates with the water jacket inlet 72, and an upper end communicating with the interior of the inner housing 44.

Figure 7:
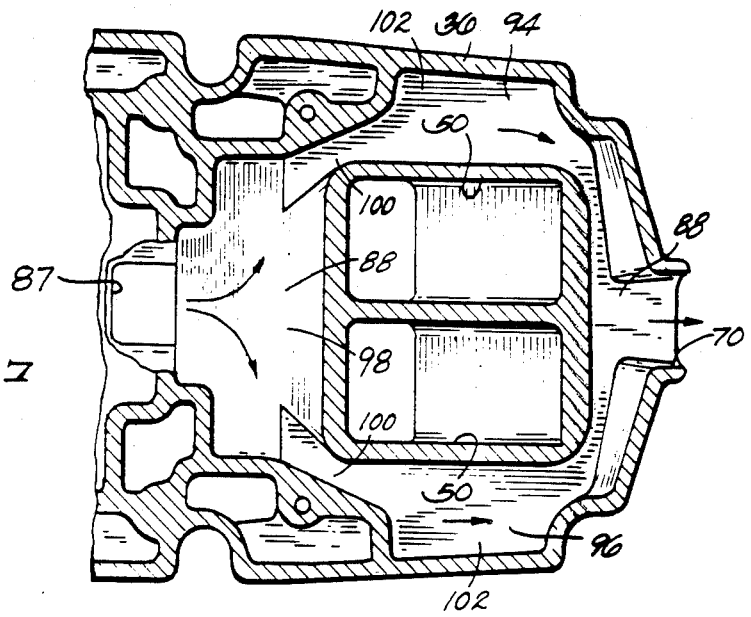
FIG. 7 is a view taken along line 7—7 in FIG. 6.
Figure 8:
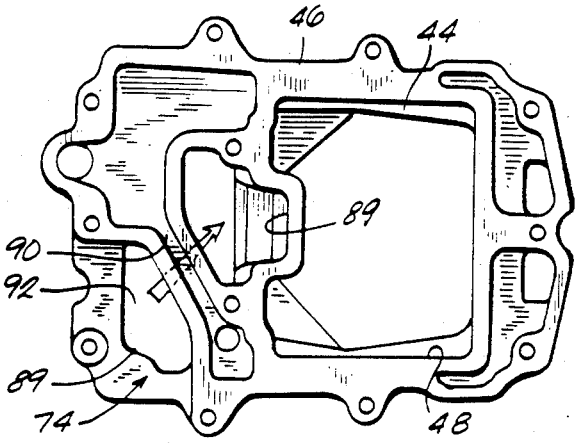
FIG. 8 is a view taken along line 8—8 in FIG. 6.
Figure 9:
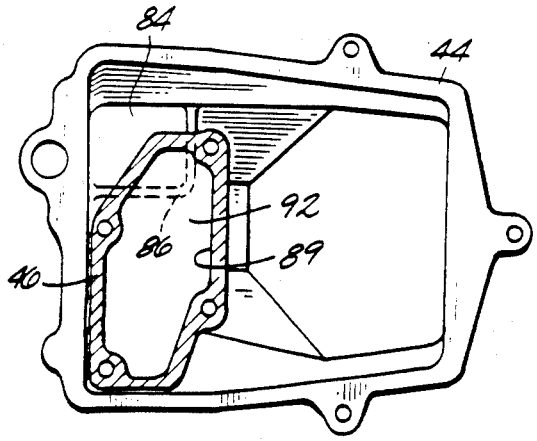
FIG. 9 is a view taken along line 9—9 in FIG. 6.

The means communicating between the engine exhaust outlet 28 and the low-speed exhaust outlet 70 also includes means communicating between the water jacket outlet 74 and the low-speed exhaust outlet 70. While various suitable means can be employed, in the preferred embodiment, this means includes, in the adaptor 36, an exhaust inlet 87 located in the adaptor lower face 38 and located forwardly of the outlet 43, and a second passage 88 extending interiorly of the adaptor 36 and communicating between the adaptor inlet 87 and the low-speed exhaust outlet 70. As best shown in FIGS. 6 and 7, the passage 88 has a forward end which communicates with the inlet 87, and a rearward end which communicates with the low-speed exhaust outlet 70. Intermediate its forward and rearward ends, the passage 88 includes branches 94 and 96 passing around the opposite sides of the first adaptor passage 50. Preferably, the adaptor 36 is manufactured by the lost foam casting process which permits the formation of internal passages such as the second passage 88.

In the preferred embodiment, the adaptor 36 includes muffler means which includes, in the passage 88, an interior portion or expansion chamber 98 having a cross-sectional area considerably greater than the cross-sectional area of the inlet 87. The muffler means also includes, in each of the branches 94 and 96 of the passage 88, a restricted portion 100, and an expansion chamber 102 having a cross-sectional area considerably greater than the cross-sectional area of the restricted portion 100.

The means communicating between the water jacket outlet 74 and the low-speed exhaust outlet 70 also includes a passage 89 communicating between the outlet 74 and the adaptor inlet 87. The passage 89 extends beneath a cooling water passage 90 in the adaptor 36 and is formed by the connector plate 46, by a plate 92 mounted on the lower end of the connector plate 46, and by the lower face 38 of the adaptor 36.

Figure 10:
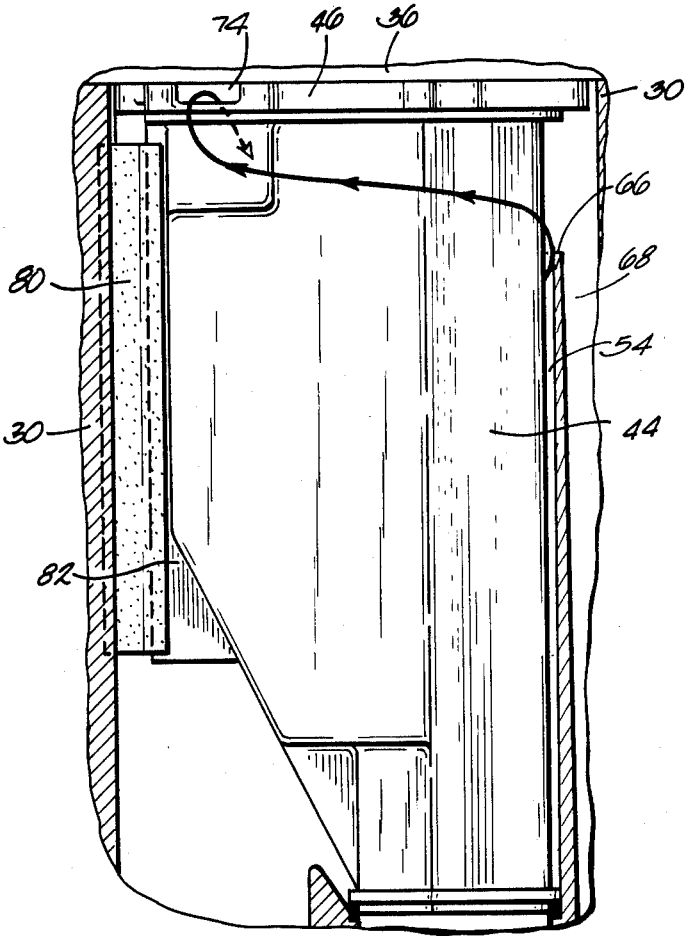
FIG. 10 is a view taken along line 10—10 in FIG. 5.

The low-speed exhaust system operates as follows. When the engine 26 is operating at relatively low speeds, water backed up in the inner housing 44 prevents discharge of exhaust gases through the high-speed exhaust outlet 40. Therefore, exhaust gases enter the upper end of the duct 84 and travel downwardly through the duct 84 to the water jacket inlet 72. This is shown by the arrows in FIG. 6. From the water jacket inlet 72, the exhaust gases bubble up through the water in the water jacket 54 and eventually emerge from the water in the first side portion 58 or rearward portion 62 of the water jacket 54. The seal 80 prevents the exhaust gases from flowing straight across the forward Portion 56 of the water jacket 54 to the outlet 74. After the exhaust gases emerge from the water in the water jacket 54, they flow, in the space above the water level 64, around the rearward portion 62 and across the second side portion 60 to the outlet 74. This is shown by the arrows in FIG. 10. During this time, substantially all of the water mixed with the exhaust gases is separated from the exhaust gases and drops into the water in the water jacket 54. From the water jacket outlet 74, the exhaust gases flow through the passage 89, in the adaptor inlet 87, through the adaptor passage 88, and out the low-speed exhaust outlet 70. This is shown by the arrows in FIG. 6.

Various features of the invention are set forth in the following claims.

We claim:

1. A marine propulsion device comprising an engine including an exhaust gas discharge port, a lower unit including a rotatably mounted propeller driven by said engine, means defining an annular chamber having a circumferential length and including a lower portion filled with water, said annular chamber also including an exhaust gas inlet located below the level of the water and communicating with said engine exhaust gas discharge port, and an exhaust gas outlet located above the level of the water, and means for directing exhaust gas flow from said exhaust gas inlet of said chamber to said exhaust gas outlet of said chamber through a distance which extends in and around said chamber and which is substantially greater than 50% of the circumferential length of said chamber.

2. A marine propulsion device as set forth in claim 1 wherein said marine propulsion device further comprises a second exhaust gas outlet, and conduit means communicating between said engine exhaust gas discharge port and said second exhaust gas outlet, and wherein said annular chamber surrounds said conduit means so that the water cools said conduit and the exhaust gases therein.

3. A marine propulsion device as set forth in claim 1 wherein said exhaust gas inlet of said chamber and said exhaust gas outlet of said chamber are spaced apart substantially less than 50% of the circumferential length of said chamber and divide said chamber into a short segment extending between said exhaust gas inlet of said chamber and said exhaust gas outlet of said chamber and a long segment extending between said exhaust gas inlet of said chamber and said exhaust gas outlet of said chamber, and wherein said directing means includes means for preventing exhaust gases from flowing through said short segment from said exhaust gas inlet of said chamber to said exhaust gas outlet of said chamber.

4. A marine propulsion device as set forth in claim 3 wherein said means defining said chamber includes an inner wall and an outer wall, and wherein said preventing means includes a seal extending between said inner wall and said outer wall.

5. A marine propulsion deice as set forth in claim 1 wherein said chamber has a forward portion, opposite first and second side portions, and a rearward portion, wherein said exhaust gas outlet of said chamber and said exhaust gas inlet of said chamber are located in said forward portion, and wherein said directing means includes means for requiring exhaust gases flowing from said exhaust gas inlet of said chamber to said exhaust gas outlet of said chamber to flow from said forward portion to said rearward portion along said first side portion, around said rearward portion, and from said rearward portion to said forward portion along said second side portion.

6. A marine propulsion device as set forth in claim 5 wherein said means defining said chamber includes an inner wall and an outer wall, and wherein said directing means includes a seal extending between said inner wall and said outer wall.

7. A marine propulsion device as set forth in claim 1 wherein said marine propulsion device further comprises a second exhaust gas outlet, and passage means communicating between said exhaust gas outlet of said chamber and said second exhaust gas outlet.

8. A marine propulsion device as set forth in claim 7 wherein said marine propulsion device has a forward end and a rearward end, wherein said second exhaust gas outlet is located adjacent said rearward end, and wherein said exhaust gas inlet of said chamber and said exhaust gas outlet of said chamber are located adjacent said forward end.

9. A marine propulsion device as set forth in claim 8 and further comprising an adaptor connecting said lower unit to said engine and including a first passage extending through said adaptor and communicating between said engine exhaust gas discharge port and said exhaust gas inlet of said chamber, and wherein said means communicating between said exhaust gas outlet of said chamber and said second exhaust gas outlet includes a second passage extending through said adaptor.

10. A marine propulsion device as set forth in claim 9 wherein said second exhaust outlet is located in said adaptor.

11. A marine propulsion device as set forth in claim 7 and further comprising an adaptor connecting said lower unit to said engine and including a first passage extending through said adaptor and communicating between said engine exhaust gas discharge port and said exhaust gas inlet of said chamber, and wherein said means communicating between said said exhaust gas outlet of said chamber and said second exhaust gas outlet includes a second passage extending through said adaptor.

12. A marine propulsion device as set forth in claim 11 wherein said second exhaust gas outlet is located in said adaptor.

13. A marine propulsion device comprising an engine including an engine exhaust outlet, a lower unit including a rotatably mounted propeller driven by said engine, and a high-speed exhaust outlet, a generally vertically extending conduit communicating between said engine exhaust outlet and said high-spaced exhaust outlet, wall means surrounding said conduit and defining a water jacket between said wall means and said conduit, said water jacket including a lower portion filled with water, a forward portion, opposite first and second side portions, a rearward portion, an exhaust gas inlet located below the level of the water and in said forward portion, said exhaust gas inlet communicating with said engine exhaust gas discharge port, and an exhaust gas outlet located above the level of the water and in said forward portion, and a barrier located between said exhaust gas inlet of said water jacket and said exhaust gas outlet of said water jacket and extending between said wall means and said conduit for directing exhaust gas flow from said exhaust gas inlet of said water jacket to said exhaust gas outlet of said water jacket to flow from said forward portion to said rearward portion along said first side portion, around said rearward portion, and from said rearward portion to said forward portion along said second side portion.

14. A marine propulsion device as set forth in claim 13 and further comprising a low-speed exhaust gas outlet, and an adaptor connecting said lower unit to said engine and including a first passage extending through said adaptor and communicating between said engine exhaust gas discharge port and said exhaust gas inlet of said water jacket, and a second passage extending through said adaptor and communicating between said exhaust gas outlet of said water jacket and said low-speed exhaust gas outlet.

15. A marine propulsion device as set forth in claim 14 wherein said low-speed exhaust gas outlet is located in said adaptor.

16. A marine propulsion device comprising an engine including an exhaust outlet, a lower unit including a high-speed exhaust outlet and a rotatably mounted propeller driven by said engine, a generally vertical conduit communicating with said high-spaced exhaust outlet, wall means surrounding said conduit and defining a water jacket between said wall means and said conduit, said water jacket including a lower portion filled with water, a forward portion, and an exhaust gas inlet located below the level of the water and communicating with said engine exhaust outlet, and an adaptor connecting said engine to said lower unit, said adaptor including a first passage communicating between said engine exhaust outlet and said conduit, a port located forwardly of said passage and communicating with said forward portion of said water jacket at a point above the level of the water in said water jacket, a low-spaced exhaust outlet located rearwardly of said first passage, and a second passage extending interiorly of said adaptor and communicating between said port and said low-speed exhaust outlet.

17. A marine propulsion device as set forth in claim 16 wherein said first passage has opposite sides, and wherein said second passage includes first and second branches extending on said opposite sides of said first passage.

18. An adaptor for an outboard motor including a lower unit, and an engine having an exhaust gas discharge port, said adaptor having forward and rearward ends and comprising an exterior surface including an upper face adapted to be connected to the engine and having therein a first exhaust gas inlet adapted to communicate with the engine exhaust gas discharge port, a lower face adapted to be connected to the lower unit and having therein a first exhaust gas outlet, and a second exhaust gas inlet located forwardly of said first exhaust gas outlet, a first exhaust gas passage extending interiorly of said exterior surface and communicating between said first exhaust gas inlet and said first exhaust gas outlet, a second exhaust gas outlet in said exterior surface rearwardly of said first exhaust gas outlet, and a second exhaust gas passage extending interiorly of said exterior surface and communicating between said second exhaust gas inlet and said second exhaust gas outlet.

19. An adaptor as set forth in claim 18 wherein said first passage has opposite sides, and wherein said second passage includes first and second branches extending on said opposite sides of said first passage.

20. An adaptor as set forth in claim 18 wherein said second exhaust gas inlet has a cross-sectional flow area, and wherein said second passage includes an interior portion having a cross-sectional flow area greater than the flow area of said second exhaust gas inlet.

21. An adaptor for an outboard motor including a lower unit, and an engine having an exhaust gas discharge port, said adaptor comprising an exterior surface including an upper face adapted to be connected to the engine, a lower face adapted to be connected to the lower unit and having therein an exhaust gas inlet port, said exhaust gas inlet port having a cross-sectional flow area and being adapted to communicate with the engine exhaust gas discharge port, an exhaust gas outlet port spaced from said exhaust gas inlet port and located in said exterior surface, and a exhaust gas passage communicating between said exhaust gas inlet port and said exhaust gas outlet port and including a portion located interiorly of said exterior surface, and having an cross-sectional flow area greater than the flow area of said exhaust gas inlet port.

22. An adaptor as set forth in claim 21 wherein said upper face has therein a second exhaust gas inlet port adapted to communicate with the engine exhaust gas discharge port, wherein said lower face has therein a second exhaust gas outlet port, and wherein said adaptor further comprises a second exhaust gas passage extending interiorly of said adaptor exterior surface and communicating between said second exhaust gas inlet port and said second exhaust gas outlet port.

23. An adaptor as set forth in claim 22 wherein said second exhaust gas passage has opposite sides, and wherein said first exhaust gas passage includes first and second branches extending on said opposite sides of said second exhaust gas passage

24. An adaptor for an outboard motor including a lower unit, and in engine having an exhaust gas discharge port, said adaptor comprising an exterior surface including an upper face adapted to be connected to the engine, a lower face adapted to be connected to the lower unit, and muffler means including an exhaust gas inlet port located in said lower face and adapted to communicate with the engine exhaust gas discharge port, an exhaust outlet port spaced from said exhaust gas inlet port and located in said exterior surface, and an exhaust gas passage communicating between said exhaust gas inlet port and said exhaust gas outlet port, located interiorly of said exterior surface, and having therein an expansion chamber.

* * * * *